US006295735B1

(12) United States Patent
Barger

(10) Patent No.: US 6,295,735 B1
(45) **Date of Patent: *Oct. 2, 2001**

(54) UNIT DOSE SPOON

(75) Inventor: Steven Barger, Pottstown, PA (US)

(73) Assignee: Comar, Inc., Buena, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/432,722

(22) Filed: Nov. 1, 1999

Related U.S. Application Data

(63) Continuation of application No. 09/104,441, filed on Jun. 25, 1998, now Pat. No. 5,975,305.

(51) Int. Cl.[7] ..... B65D 83/00
(52) U.S. Cl. ..... 30/123.3; 206/438; 426/115
(58) Field of Search ..... 206/223, 541, 206/542, 572, 229, 438; 30/141, 326, 123, 123.3; 426/115, 123

(56) References Cited

U.S. PATENT DOCUMENTS 3,154,418 * 10/1964 Lovell et al. ..... 30/141
3,618,751 * 11/1971 Rich ..... 30/326
4,192,360 * 3/1980 Rodriquez ..... 30/141
4,387,804 * 6/1983 Austin et al. ..... 206/530
4,888,188 * 12/1989 Castner, Sr. et al. ..... 30/141
5,203,459 * 4/1993 Wade ..... 206/572
5,975,305 * 11/1999 Barger ..... 206/572

* cited by examiner

*Primary Examiner*—Jim Foster
(74) *Attorney, Agent, or Firm*—Eugene E. Renz, Jr., P.C.

(57) ABSTRACT

A unit dose spoon having a bowl portion, a recessed handle portion communicating with the bowl portion. An upwardly extending pedestal is mounted in the recessed handle portion and is provided with an upwardly extending cutting blade on the top surface thereof. A container is integrally hinged to the free end of the handle portion and contains a unit dose of fluid such as a medicine, which is sealed in the container by a rupturable plastic cover. When the container is folded forwardly toward the handle portion and pushed downwardly toward the pedestal, the blade thereon punctures the plastic cover to allow the fluid to flow from the container into the recessed handle portion and into the bowl portion. The unit dose spoon is formed of molded plastic and is disposable.

6 Claims, 1 Drawing Sheet

FIG. 1
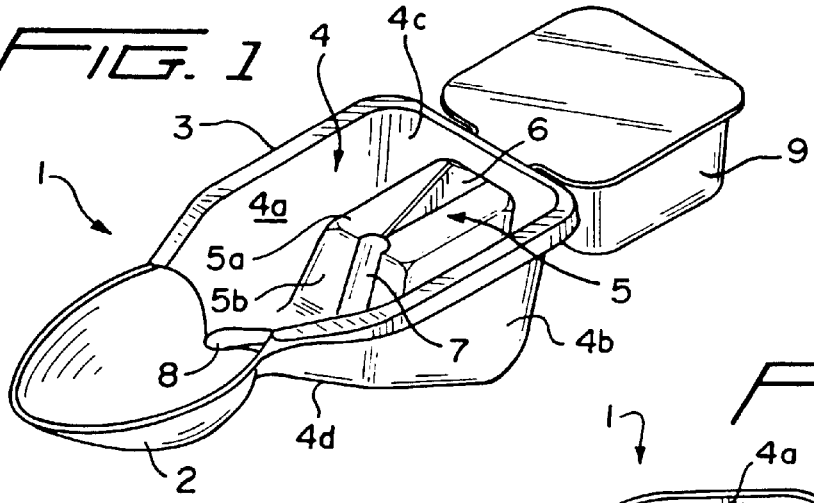
FIG. 2
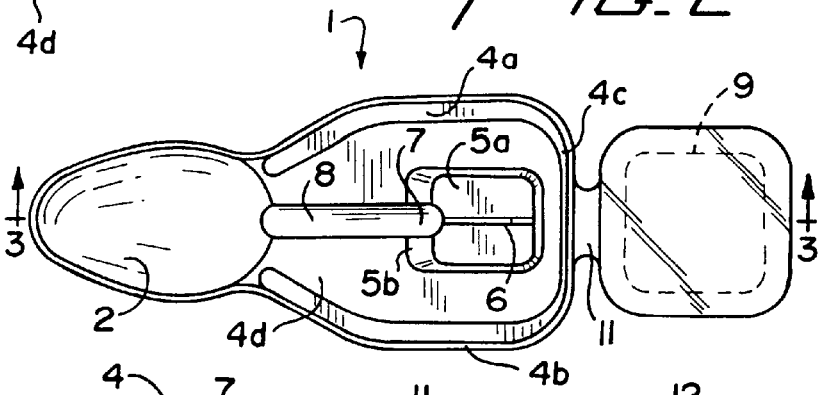
FIG. 3
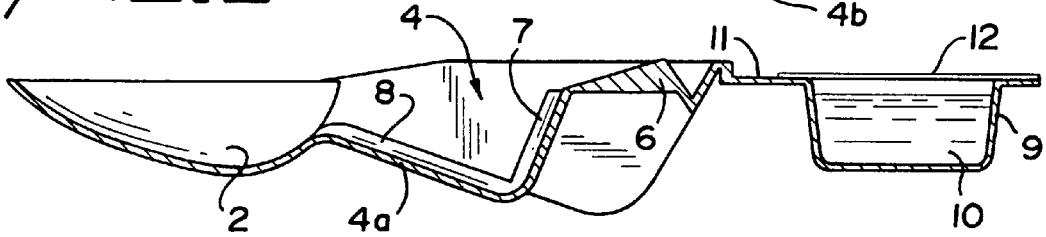
FIG. 4
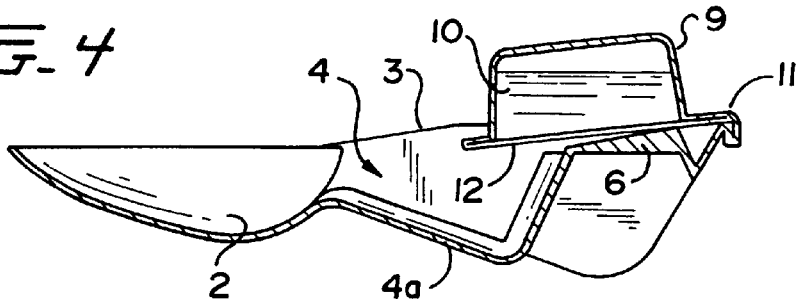
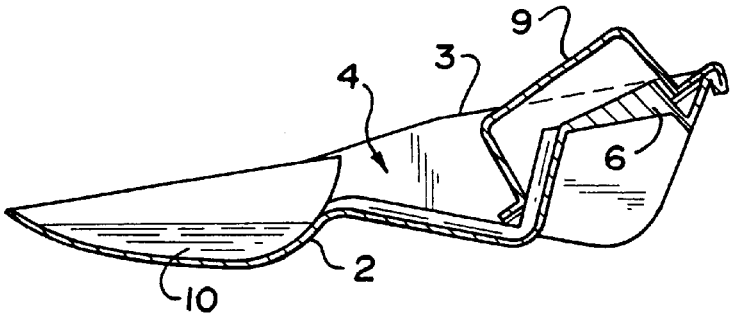
FIG. 5

UNIT DOSE SPOON

This application is a continuation of application, Ser. No. 09/104,441, filed Jun. 25, 1998, U.S. Pat. No. 5,975,305.

BACKGROUND OF THE INVENTION

Various spoons have been proposed having hollow handles containing various types of fluids adapted to be dispensed into the bowl portion of the spoon.

While these spoons have been satisfactory for their intended purpose, the unit dose spoon of the present invention is an improvement thereon in that a container containing a unit dose of a fluid, such as a medicine, is integrally formed with the spoon and is adapted to be manipulated in such a way as to dispense the unit dose from the container into the bowl portion of the spoon. The spoon and container can be of plastic, simultaneously molded as a single entity, and is disposable after use.

SUMMARY OF THE INVENTION

The unit dose spoon of the present invention comprises, essentially, a spoon having a bowl portion and a recessed handle portion communicating with the bowl portion. An upwardly upwardly extending pedestal is mounted in the recessed handle portion and is provided with an upwardly extending cutting blade on the top surface thereof. A first channel is provided in an end wall of the pedestal communicating with a second channel in the recessed handle portion which communicates with the bowl portion of the spoon. A container or tub is integrally hinged to the free end of the handle portion and extends outwardly therefrom. The tub contains a unit dose of fluid, such as medicine, and is closed by a rupturable plastic cover.

By this construction and arrangement, when the tub containing the unit dose is folded forwardly toward the handle portion and pushed downwardly toward the pedestal the blade thereon punctures the plastic cover to allow the unit dose to flow from the tub into the channels and recessed handle portion. By tilting the spoon, the unit dose flows from the recessed handle portion into the bowl portion of the spoon.

BRIEF DESCRIPTION OF THE DRAWINGS

FIG. 1 is a perspective view of the unit dose spoon of the present invention;

FIG. 2 is a top plan view of the unit dose spoon shown in FIG. 1;

FIG. 3 is a view taken along line 3—3 of FIG. 2;

FIG. 4 is a sectional side elevational view showing the unit dose container folded forwardly; and FIG. 5 is a sectional side elevational view showing the unit dose container pushed downwardly to rupture the cover thereon, the spoon being tilted to allow the fluid dispensed from the container to flow into the bowl portion of the spoon.

DESCRIPTION OF THE PREFERRED EMBODIMENTS

Referring to the drawings and, more particularly, to FIGS. 1 and 2, the unit dose spoon of the present invention comprises a spoon 1 having a bowl portion 2 and a handle portion 3. The handle portion 3 is provided with a recess 4 having side walls 4*a,* 4*b,* an end wall 4*c,* and an inclined bottom wall 4*d.*

An upwardly extending pedestal 5 is mounted in the recess 4 and is integral with the bottom wall 4*a* thereof The pedestal 5 has a top wall 5*a* upon which an upwardly extending knife edge or cutting blade 6 is mounted, and the forward wall 5*b* of the pedestal is provided with a first channel 7, communicating with one end of a second channel 8 having its opposite end communicating with the spoon bowl 2.

As will be seen in FIGS. 2 and 3*a,* container or tub 9 containing a unit dose of fluid, such as medicine 10, is integral hinged as at 11 to the free end of the handle portion 3. The unit dose 10 is sealed within the container by a rupturable plastic cover 12 hermetically sealed to the top of the container 9.

In use, as shown in FIG. 4, the container 9 is folded forwardly about hinge 11 in a direction toward the bowl portion 2 and blade 6 so that the cover 12 engages the blade 6. The container 9 is then pushed downwardly so that the blade 6 ruptures the cover 12 allowing the fluid 10 to flow from the container 9 into the recessed portion 4 of the handle 3. By tilting the spoon 1 shown in FIG. 5, the fluid 10 flows from the recessed portion 4 of the handle 3 into the bowl portion 2 of the spoon 1.

From the above description, it will be readily apparent to those skilled in the art that the improved unit dose spoon of the present invention is relatively inexpensive to manufacture since the spoon 1, container 9, and integral hinge 11 can be formed of plastic and simultaneously molded as integral assembly. The hermetically sealed container 9 provides increased shelf life for the unit dosage, and the blade 6, integral with the pedestal 5, precludes the necessity of providing a separate cutter for opening the cover 10.

It is to be understood that the form of the invention herewith shown and described is to be taken as a preferred example of the same, and that various changes in the shape, size, and arrangement of parts may be resorted to, without departing from, the spirit of the invention or scope of the subjoined claims.

I claim:

1. A unit dose spoon for use with a container having a predetermined quantity of a fluid sealed by a cover on the container comprising a bowl portion and a handle portion having one end integral with the bowl portion, a recess provided in said handle portion communicating with said bowl portion, means for connecting the other end of said handle to the container, and means mounted on said handle for rupturing the cover to thereby allow fluid to flow from the container into the recess in said handle portion.

2. A unit dose spoon according to claim 1, wherein the means for rupturing said cover comprises a fixed blade mounted in the recess of said handle portion, the container being foldable toward the bowl portion of the spoon, whereby the cover is pressed against the blade to rupture the cover thereby allowing the fluid to flow from the container into the recess of said handle and into the bowl portion of the spoon.

3. A unit dose spoon according to claim 2, wherein the recess in the handle portion of the spoon has a pair of said walls, an end wall, and a bottom wall, a vertically extending pedestal integral with the bottom wall of said recess, said pedestal having an end wall and a top wall, said blade being fixedly mounted to the top wall of said pedestal and extending upwardly therefrom.

4. A unit dose spoon according to claim 3, wherein a first channel is provided in said end wall of said pedestal, a second channel provided in the bottom wall of the recess in the handle portion, said second channel having one end communicating with said first channel and a second end communicating with the bowl portion of the spoon.

5. A unit dose spoon according to claim 1, wherein the spoon, container, and means for hingedly connecting the container to the handle portion are formed of plastic molded as an integral entity.

6. A unit dose spoon according to claim 5, wherein the cover is formed of plastic hermetically sealed to said container.

* * * * *